United States Patent [19]

Eddins

[11] 3,990,196

[45] Nov. 9, 1976

[54] FABRICATED WINDOW CONSTRUCTION

[75] Inventor: Timothy O. Eddins, Pelham, Ala.

[73] Assignee: Redkco, Inc., Pelham, Ala.

[22] Filed: Feb. 5, 1976

[21] Appl. No.: 655,633

[52] U.S. Cl. ..... 52/106; 52/475; 52/456; 52/758 H

[51] Int. Cl.[2] ..... E04H 3/08

[58] Field of Search ..... 52/475, 456, 758 H, 52/106

[56] References Cited

UNITED STATES PATENTS

| | | | |
|---|---|---|---|
| 2,701,396 | 2/1955 | Perkins et al. | 52/758 H X |
| 3,811,785 | 5/1974 | Hagglund | 52/758 H X |
| 3,901,612 | 8/1975 | Camin | 52/758 H X |

*Primary Examiner*—Price C. Faw, Jr.
*Assistant Examiner*—Carl D. Friedman
*Attorney, Agent, or Firm*—Jennings, Carter & Thompson

[57] ABSTRACT

A fabricated window, preferably, though not necessarily, made from extruded shapes and which is so put together as to be suitable for use particularly in those instances where a tamper-proof window is required, by way of example, for use as windows in mental institutions. Particularly, the improved construction comprises means simply to slip the various parts of the window together by the provision of certain groove formations in the jambs, rails, and mullions together with a final assembly part in the corners of the window so secured to certain portions of the window parts as to prevent unauthorized disassembly of the window when the same is in use.

2 Claims, 9 Drawing Figures

41a
41
41a 39a
39

22
23
24
14
21
26

28
31
29
32
27

13
22
21
23
26
24

19
37
38

34
34a
33
34b
36
33
18

FABRICATED WINDOW CONSTRUCTION

This invention relates to an improved window construction and has for an object the provision of a window which may be strong enough, tamper-proof enough and otherwise generally suitable for use in places of detention, such as in sanitaria, jails and the like.

More in detail, my invention contemplates a window, preferably, but not necessarily, formed of aluminum extrusions, the various parts such as the jambs, rails, and mullions all being formed so as to interfit and interlock, with the addition only of very minor parts such as spacers, the entire window when assembled being held together by locking corner members.

In the art to which my invention relates there is a need for an improved, tamper-proof, economical vent or window for use particularly in those installations where the window is apt to be tampered with, as for instance in mental institutions and jails. In prior art windows such for instance as welded steel windows, when the inmates of such detention facilities damage windows by bending portions of them, as often happens, it is necessary to remove the entire window and discard it. My improved window is so designed that vent portions may be replaced without having to discard the entire window, and this may be done by the building superintendent as distinguished from having to send the window back to the factory or to a special repair shop. Further, with my improved window no special tools are required when replacing component parts thereof.

A window illustrating features of my invention is shown in the accompanying drawings forming a part hereof in which.

Figure 1:
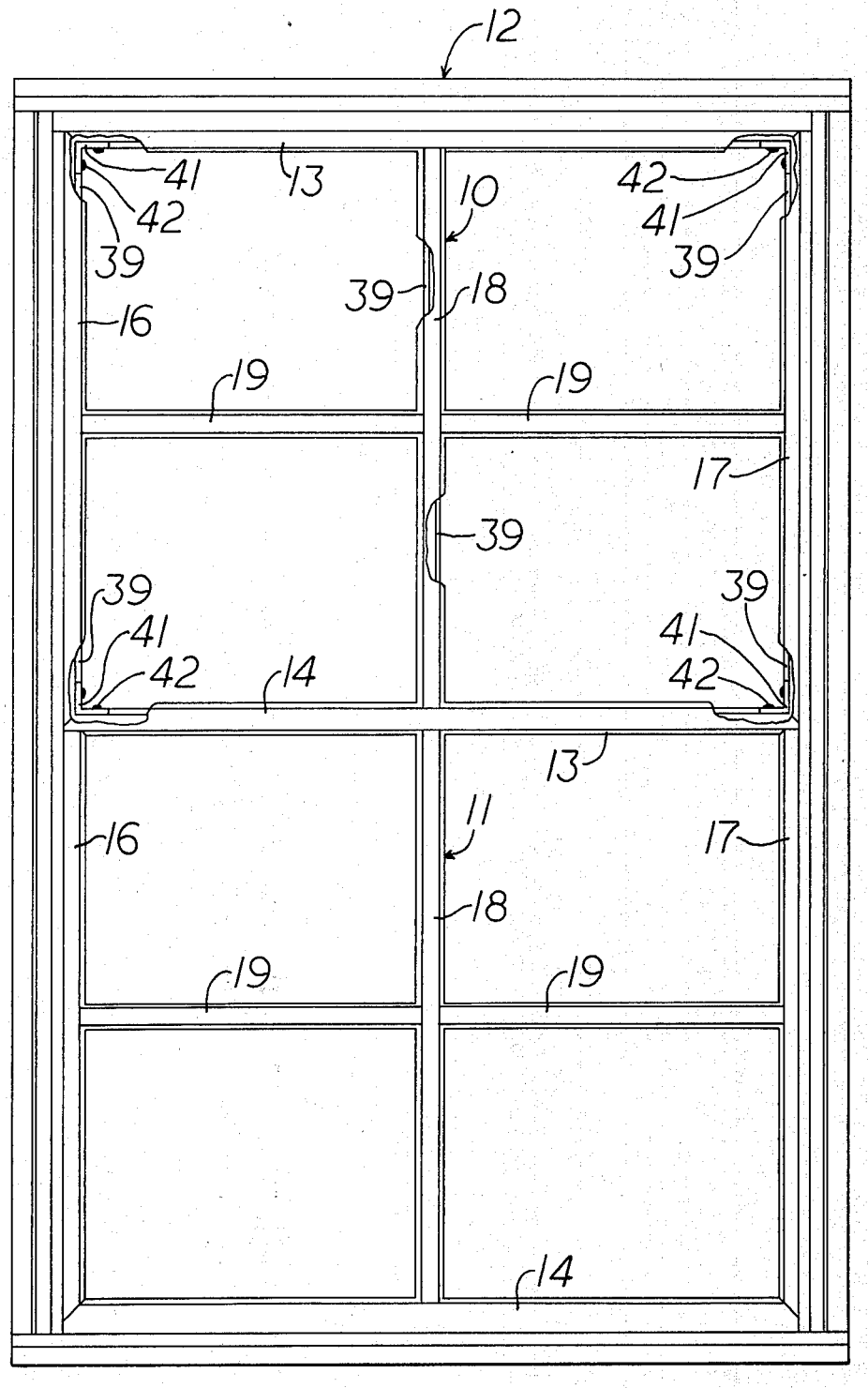
FIG. 1 is a front elevational view of a double hung window mounted in a suitable frame, which window embodies my invention.
Figure 2:
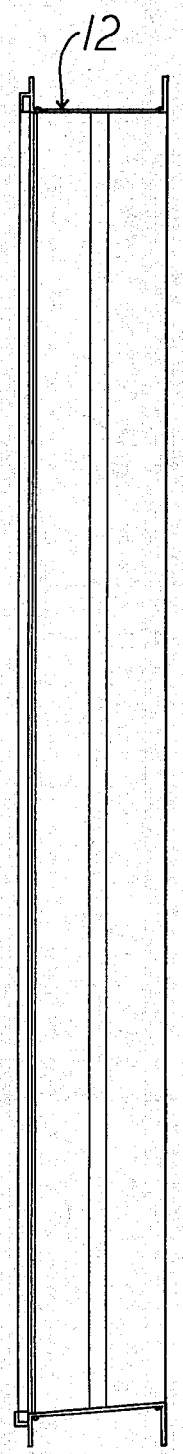
FIG. 2 is a side elevational view.

Referring now to the drawings for a better understanding of my invention, in FIG. 1 I show a double hung window in which my improved construction may be incorporated in an upper vent indicated generally by the numeral 10 and in a lower vent indicated generally by the numeral 11. The vents or windows may be installed in a suitable frame indicated generally at 12. As the description proceeds it will be apparent that my improved construction may be employed for double hung windows, casement type windows, doors and other forms of closures for openings in building walls, either external or internal.

In view of the fact that each vent is constructed substantially identically, the description of a single vent will follow.

Each vent comprises essentially an upper rail 13, a lower rail 14, vertical jambs 16 and 17, at least one vertical mullion 18 and, if there is a single mullion 18, at least two horizontal mullions indicated at 19.

As before stated, the object of my invention is to secure parts together in effect to form a frame for a window or vent which has the advantages heretofore discussed.

Figures 3, 4, 5, 6, 7, 8, 9:
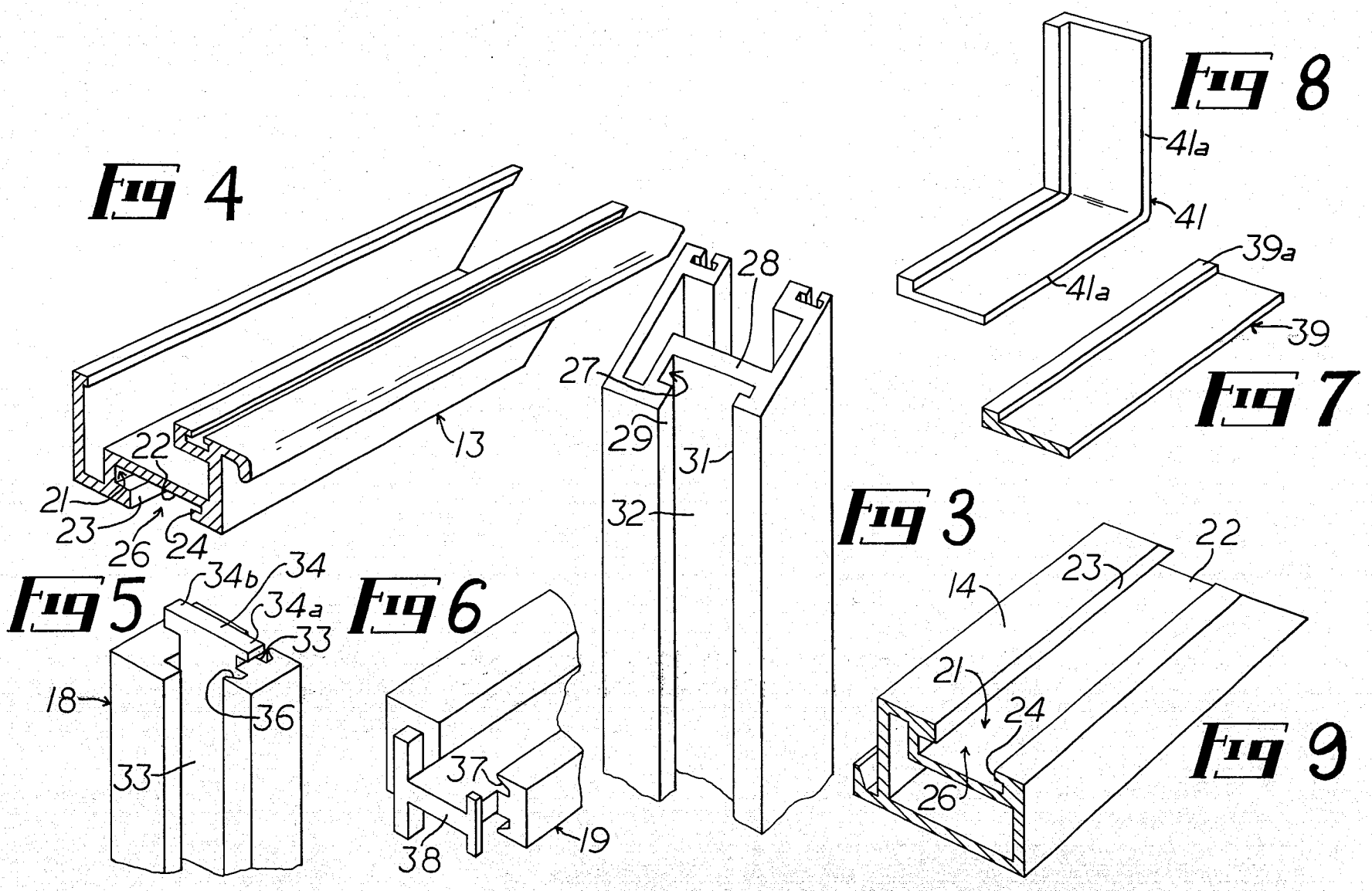
FIG. 3 is a perspective fragmentary view of a jamb for my improved window, illustrating the mitered corner thereof.
FIG. 4 is a sectional perspective view of an upper rail for my window.
FIG. 5 is a perspective end view of a vertical mullion.
FIG. 6 is a perspective fragmental end view of a horizontal mullion.
FIG. 7 is a perspective view of a length of spacer.
FIG. 8 is a perspective view of one of the corner locking members.
FIG. 9 is a sectional perspective view of a lower rail for my window.

Referring particularly to FIGS. 4 and 9 the rails 13 and 14 may comprise an aluminum extrusion in which the inner side thereof is provided with an elongated, continuous groove indicated generally by the numeral 21. The groove 21 is more particularly defined as having a back wall 22 and spaced, continuous lips 23 and 24, the edges of which define an opening 26 for the groove. From the construction just described it will be seen that various pieces, if properly configured on their ends, may be interlocked and interfitted into the groove 21, thus to be held rigidly in place relative to the rails 13 and 14.

In FIG. 3 the jamb 16–17 is shown as comprising an extruded member, preferably of aluminum, and having a slot indicated generally at 27 along its inner side. The slot 27 is substantially identical cross-sectionwise as is the slot 21 and is similarly dimensioned. That is to say, the slot 27 is formed by the back wall 28 and the spaced, forwardly disposed lips 29 and 31, this construction resulting in a continuous opening for the groove indicated at 32.

The vertical mullions 18 also may be formed of an aluminum extrusion. As shown in FIG. 5 the mullion may be grooved at 33 which as will later appear is adapted to receive a spacer for the horizontal mullions. The groove 33 is duplicated on the opposite side of the mullion. At its end each mullion strip section is cut as shown in FIG. 5 to provide a cruciform-shaped section 34 which will interfit with the groove 21, permitting the assembly of the vertical mullion by placing the section 34 in the end of the groove of a rail and sliding the mullion toward the center thereof. The vertical mullion is provided also with glazing grooves 36 along the sides.

The horizontal mullions are illustrated in FIG. 6 and again may comprise an aluminum extrusion. The horizontal mullions 19 are provided with glazing grooves 37. At the ends the mullions 14 are cut away to leave a locking section indicated generally at 38 and which is cross-sectioned to fit slidably within the groove 33 of the mullion 18. As noted the section 38 also is of somewhat double cruciform shape, whereby the section 38 may be slidably engaged in the groove 33 so that the horizontal mullion may be slid to its proper position.

In FIG. 7 I show a section of a spacer member 39 which is employed to hold the vertical mullion and horizontal mullions in their proper spaced relationship relative to the rails and jambs. The member 39 is somewhat L-shaped in cross section and has a rearward portion 39$^a$ which is thicker than the remainder of that section.

In FIG. 8 I show an L-shaped locking member 41 each leg 41$^a$ of which is adapted to fit slidably into the grooves 21 and 27 of the respective parts, as shown, thus to lock the frame together as will be explained.

From what has been described it is now possible to explain the assembly of my improved window together with further advantages thereof.

In assemblying the window it is preferable to start with a lower rail 14. The first operation is to insert the vertical mullion with its locking element 34 engaged in the groove 21 of the lower rail 14, the vertical mullion being moved along to the appropriate place, lengthwise of the lower rail. Next, a length of the spacer 39 is inserted in the groove 21, from each end thereof, and these strips are long enough, when the locking members 41$^a$ are put in place as will be described, to firmly position and hold the vertical mullion at its proper place.

The next operation is to put into place two of the L-shaped locking members 41, at the ends of the lower rail, one leg 41$^a$ of which extends into the slot of the lower rail and the other leg 41$^a$ of which extends into the slots 27 of the jambs. Next, two vertical spacers 39 are dropped into the slots 27 of the jambs. Two vertical spacers are then dropped into the slots 33 of the vertical mullion and after that the two horizontal mullions 19 are slid into place, the locking sections 38 on the ends thereof being slidably and snugly fitting in the slots 33 of the vertical mullion and the slots 27 of the jambs. Next, spacers 39 are dropped into the grooves 27 of the jambs 16 and 17 and spacers 39 are dropped into the grooves 33 of the vertical mullions 18. Then spacers 39 are slid into the groove 21 from each end thereof, in the upper rail 13. Next, using a pair of the locking members 41 I insert one of the legs 41$^a$ thereof of each into the ends of the slot 21 in the top rail 13. The top rail carrying the then protruding other legs 41$^a$ of the members 41 is then brought downwardly so that those legs enter the slots 27 of the jambs.

In order for the section 34 of the vertical mullion to fit into the slot of the upper rail it is necessary to cut away the protruding portions 34$^a$ and 34$^b$, namely, to eliminate the cruciform shape at that point.

The final operation is to insert some form of fastener through each of the legs of the members 41 into the adjacent frame member. By way of example, I may use what I call "pop" rivets, blind rivets, or the like, indicated at 42.

It will be apparent from the description given that I have devised an improved, economical and tamperproof window. In the event of damage to any particular component the vent may be removed from its frame and by cutting loose the rivets or rivet in the corner locking members the entire structure may be disassembled by going into the reverse of what is described herein.

Also, while I have described my improved window as having a single vertical mullion and two horizontal mullions, it will be obviously apparent that the same may have a single horizontal mullion and two vertical mullions. Still further, while in the description and claims I claim a window construction, I intend by that term to include any forms of frames which may be used for closing openings in buildings, either internal or external, such as doors, screens and the like.

In actual practice my invention has proven to be extremely satisfactory. My improved window is easy to fabricate, is extremely rigid when assembled and has been accepted by the designers and operators of institutions for the mentally retarded.

While I have shown my invention in but one form, it will be obvious to those skilled in the art that it is not so limited, but is susceptible of various changes and modifications without departing from the spirit thereof.

What I claim is:

1. In a window, a. jambs, each of which in extent has an inwardly facing open groove with locking flanges extending along the edges of the grooves, b. upper and lower rails having cross sectional groove and locking flange configurations substantially the same as those of the jambs, c. at least one vertical mullion having along each side elongated grooves and locking flanges substantially the same as those of the jambs, d. at least two horizontal mullions grooved along the sides thereof, e. spacers for the horizontal mullions in the grooves of the jambs and vertical mullion and of an extent to hold the horizontal mullion against vertical movement, f. spacers for the vertical mullion in the grooves of the upper and lower rails and of an extent to hold the vertical mullion against horizontal movement, g. locking elements on the ends of the horizontal and vertical mullions locked into the grooves of the adjacent jambs, rails, or mullions, respectively, h. substantially right angular locking members for each corner of the window having legs slidably fitted into the grooves of the rails and jambs, and i. fastening means securing at least one leg of each of the locking members to the jamb or rail.

2. A window as defined in claim 1 in which the locking elements on the ends of the horizontal and vertical mullions comprise cruciform configurations adapted to interfit and interlock with the grooves of the adjacent jambs, rails, or mullions, as the case may be.

* * * * *